United States Patent [19]

Hamilton et al.

[11] Patent Number: 5,011,127

[45] Date of Patent: Apr. 30, 1991

[54] MULTIPLE DOCUMENT DETECTOR

[75] Inventors: Thomas A. Hamilton, Fife, Scotland; Michael M. Kerrigan, Rogerstown Rush, Co., Ireland; John A. Wilson, Livingston, Scotland

[73] Assignee: Unisys Corporation, Blue Bell, Pa.

[21] Appl. No.: 477,905

[22] PCT Filed: Feb. 27, 1989

[86] PCT No.: PCT/US89/00766

§ 371 Date: Jan. 17, 1990

§ 102(e) Date: Jan. 17, 1990

[87] PCT Pub. No.: WO89/08068

PCT Pub. Date: Sep. 8, 1989

[30] Foreign Application Priority Data

Mar. 4, 1988 [GB] United Kingdom ..... 8805180

[51] Int. Cl.[5] ..... B65H 7/12

[52] U.S. Cl. ..... 271/262; 271/263; 271/265; 271/272

[58] Field of Search ..... 271/258, 259, 262, 263, 271/265, 272, 273, 274

[56] References Cited

U.S. PATENT DOCUMENTS 3,176,981 4/1965 Vandeman ..... 271/263
4,550,252 10/1985 Tee ..... 271/263 X
4,664,369 5/1987 Graef et al. ..... 271/263

FOREIGN PATENT DOCUMENTS 2215710 9/1989 United Kingdom ..... 271/262

*Primary Examiner*—David H. Bollinger
*Attorney, Agent, or Firm*—Mark T. Starr; Thomas J. Scott

[57] ABSTRACT

A multiple document detector uses a driven wheel (40) opposed by an idler wheel (44) on a castoring arm (60). The wheels (40,44) each have a coefficient of friction against a document greater than the coefficient of friction of a document against another document. When a sensor (14A,14B) senses the presence of a document (26) a solenoid (70) operates to attract a magnetic slug (58). If only one document (26) is present the idler wheel (44) stays in a preferred position. If two documents are present the solenoid (70) has sufficient force to cause the idler wheel (44) to push one document (26) to slide against another. In doing so the movement of the idler wheel (44) is detected by a microswitch (18) which signals the presence of multiple documents.

12 Claims, 5 Drawing Sheets

MULTIPLE DOCUMENT DETECTOR

The present invention relates to an apparatus for detecting documents moving along a track. It particularly relates to an apparatus operative to detect the movement of two or more documents together down the track.

Document tracks are used in document encoding and cheque sorting machines. Tracks are also used for moving letters and mail, bank notes and indeed, any thin planar items. Should more than one document move down a track at the same time, multiple documents are presented to work stations along the track and erroneous operation occurs. It is therefore important to detect when more than one document moves along a track.

It is known to provide pneumatic suction along both sides of a track. A single document is attracted to a suction nozzle on only one side of the track, whereas a multiple document provides attraction to suction nozzles on both sides of each track. By sensing the increase in pressure on each side of the track, a multiple document is detected. This is an expensive solution in that a pneumatic vacuum source is required together with pneumatic sensors.

It is also known to shine light across the path of an advancing document. If a fall in light level is detected, a document is signalled as being present. If, whilst a document is present, a further sharp fall in light level is detected, it is signalled that multiple documents are present.

Should multiple documents be detected, the document processing machine or other apparatus is stopped for the multiple document to be removed. Alternatively, automatic diverting means can be brought into play to divert the multiple documents from the track or to separate the documents. Such further means do not form part of the present invention.

In the photo-optic approach it is very difficult indeed to detect multiple documents when two documents are presented, moving along the track, with their leading edges aligned, since no further sharp fall in light transmission will be perceived, the sharp fall having all occurred along the leading edge of the two documents.

The present invention seeks to provide detection of multiple documents moving along a track where the documents can be aligned at their leading edges but avoiding the complication of the pneumatic method.

In the preferred embodiment of the present invention, since it is known and usual to urge the document along the track by a pair of opposed wheels, one of which is driven, it is provided that the combination of the driven wheel and the idler wheel serves the secondary and dual purpose of driving the document along the track. A synergistic combination is thereby obtained, a dual function being served by one set of items.

While the invention allows for the idler wheel to be maintained in its preferred position by means of springs and other elastic members, it is preferred that the idler wheel is maintained at the distal end of a castor arm fixed in association with the track. In the preferred embodiment the idler wheel remains in the preferred position when a single document is in the nip by virtue of a castoring action against the moving document. Likewise, when no document is in the nip, the idler wheel is maintained in the preferred position by a castoring action against the drive wheel.

In the preferred embodiment the displacement means for the idler wheel comprises an electromagnet operative to attract a magnetic core provided in association with the bearing whereon the idler wheel rotates.

In the preferred embodiment of the present invention, operation of the document detector is not continuous, but is dependent upon a document presence sensor detecting when a document enters the nip. The displacement means (i.e., the electromagnet) is operated only when the document presence sensor indicates that a document is in the nip. In this manner the idler wheel is always in its preferred position prior to entry of a document into the nip.

The preferred embodiment also provides that the idler wheel, in being urged away from its preferred position, transversely to the direction of movement of a document in the track, urges the document adjacent thereto out of the track, thereby indicating to an operator, by protrusion of a document, where the offending document may be. The urging of the adjacent document out of the track happens as a result of the idler wheel becoming angled relative to the direction of movement of the adjacent document in the track.

The preferred embodiment provides an apparatus which may be used as document drive wheel pairs throughout document processing apparatus of any kind, where a secondary function of multiple document detection is automatically provided.

The present invention is further explained, by way of an example, by the following description taken in conjunction with the appended drawings in which:

FIG. 5 shows an elevated view of the multiple document detector of FIG. 4 with a single document progressing there-through.

FIG. 6 shows the document detector in elevation of FIGS. 4 and 5, this time with a multiple document moving there-through.

Figure 1:
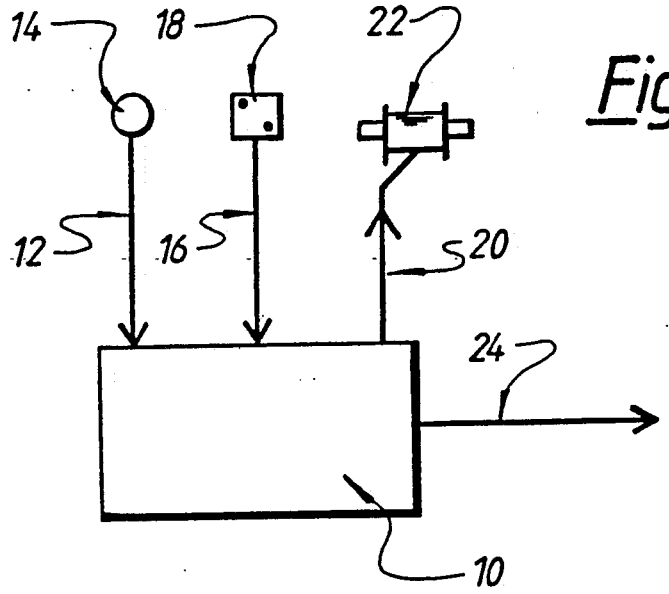
FIG. 1 shows a schematic block diagram of the system embodying the preferred embodiment of the present invention.

FIG. 1 shows a schematic diagram of the multiple document detector according to the preferred embodiment. A controller 10 is operative to receive input 12 from a photo-optic document presence sensor 14, to receive input 16 from an idler wheel displacement sensor 18, to provide output 20 for driving displacement means 22 (as hereinafter described) to urge an idler wheel away from a preferred position, and operative to provide a signal output 24 indicating the presence of multiple documents.

Figure 2:
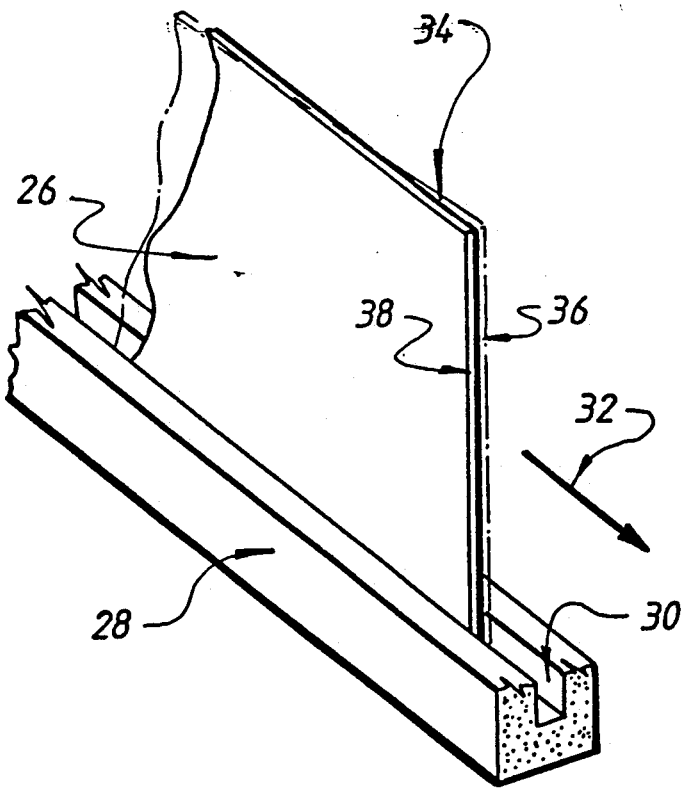
FIG. 2 shows a projected view of a document moving along a track.

FIG. 2 is a projected view of a document moving along a track. A document 26 moves along a track 28 having a groove 30 wherein the document 26 moves as indicated by a first arrow 32. The document 26 may be move along the track 28 by any means known in the art. The present invention seeks to provide power to propel a document 26 along a track 30 in addition to the multiple document detection function hereinafter described.

A second, undesired document 34, shown in phantom outline, may accompany the desired document 26 along the track 28. The undesired document 34 is shown in FIG. 2 with its leading edge 36 in alignment with the leading edge 38 of the desired document 26. The present invention seeks to provide detection of multiple documents 26, 36 as shown in FIG. 2.

Figure 3:
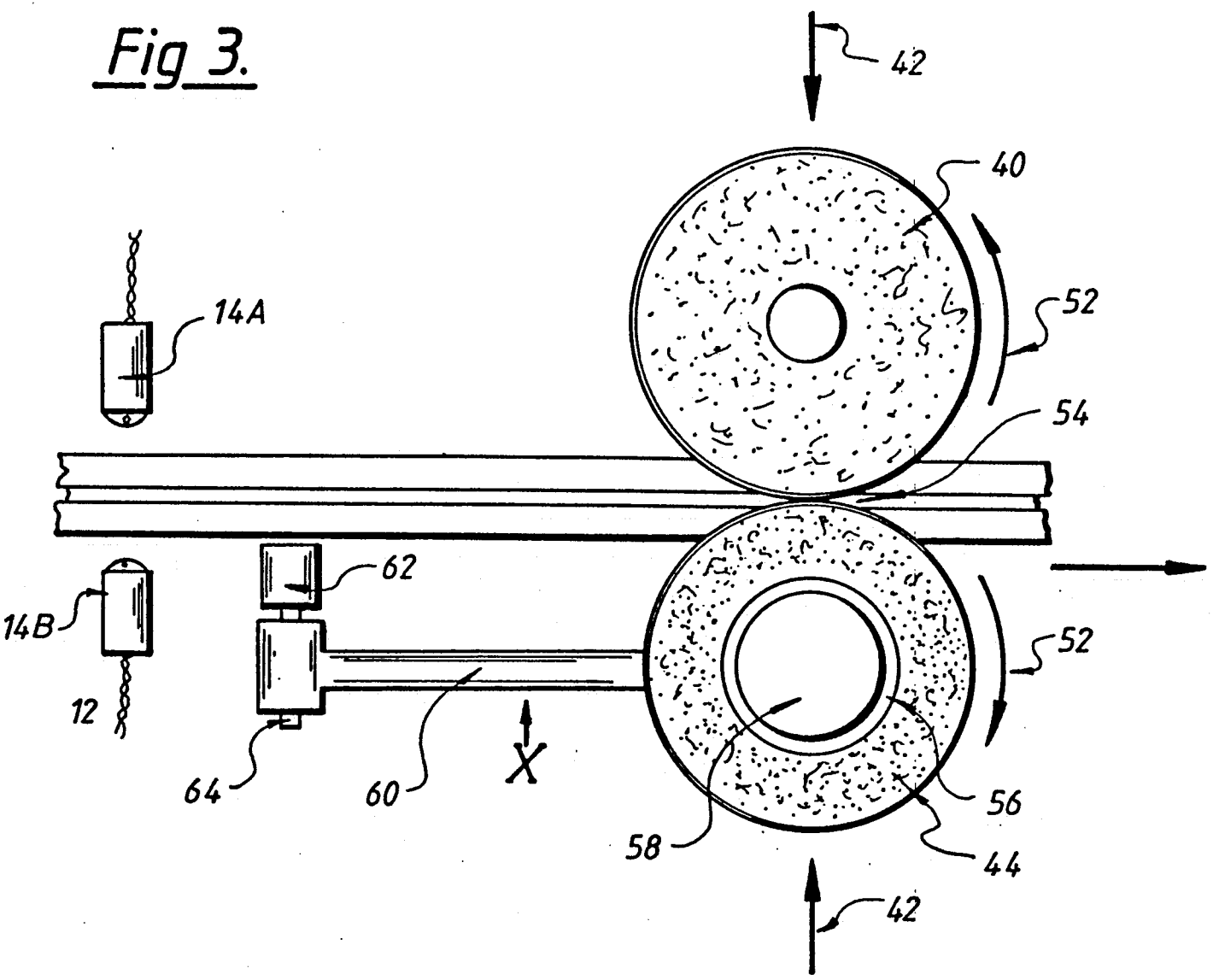
FIG. 3 shows a plan view of a multiple document detector according to the preferred embodiment of the present invention.
Figure 4:
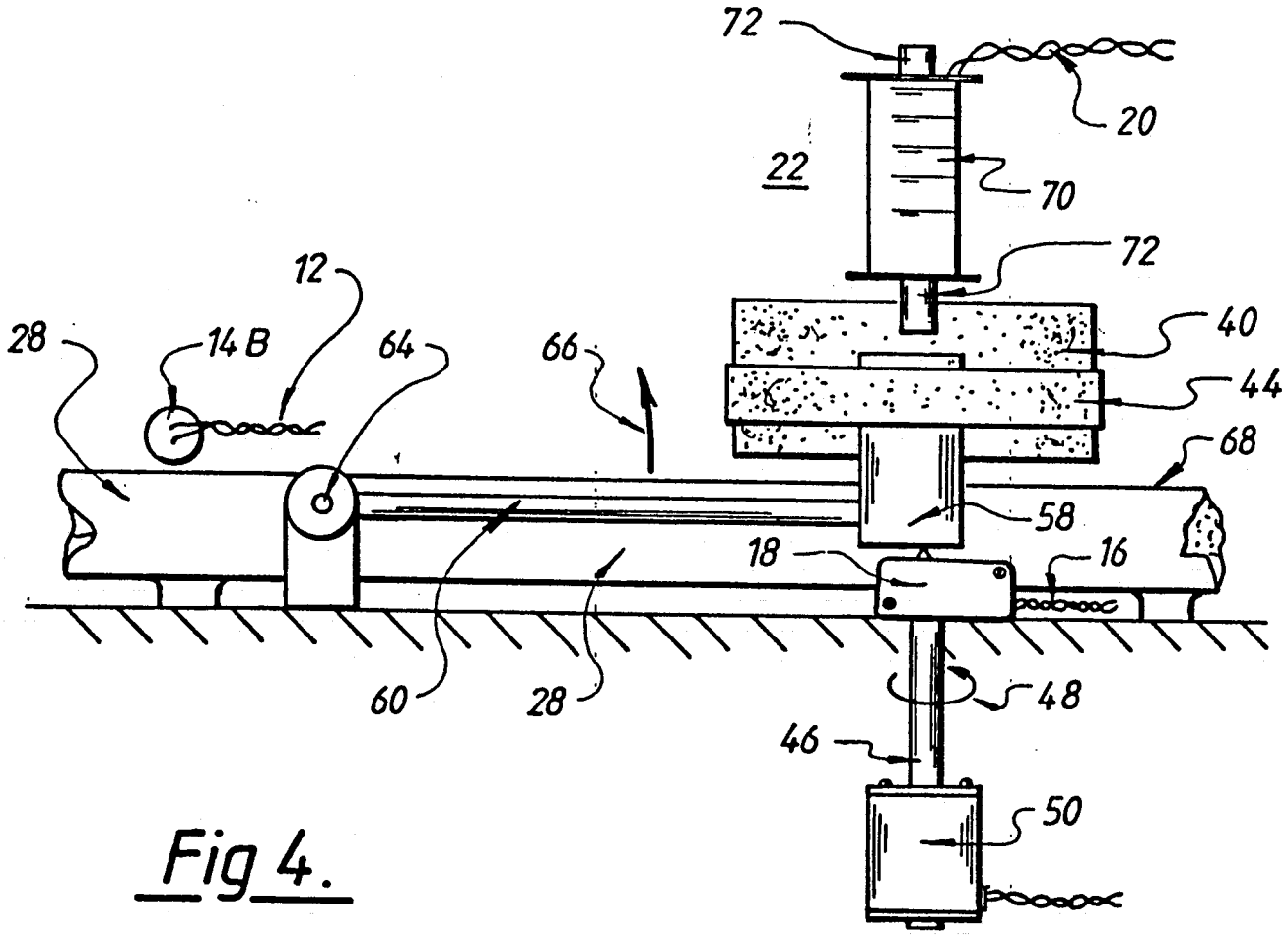
FIG. 4 shows an elevated view of the multiple document detector of FIG. 3 looking in the direction of the arrow X.

FIG. 3 shows a plan view of a multiple document detector according to the present invention. FIG. 4 shows an elevated view of the document detector of FIG. 3 looking in the direction of the arrow X of FIG. 3.

A driven wheel 40 is urged as indicated by second arrows 42 against an idler wheel 44. The driven wheel 40 is turned by a shaft 46 as generally indicated by a third arrow 48 by means of a motor 50. In FIG. 3 the driven wheel 40 and the idler wheel 44 turn as indicated by fourth arrows 52. The combination of the driven wheel 40 pushing against the idler wheel 44 forms a nip 54 at their point of contact where-between a document 26 can be introduced. The idler wheel 44 is maintained by an idler wheel bearing 56 on a magnetic support slug 58. The magnetic support slug 58 is in turn supported at the distal end of a castor arm 60 held on a support pillar 62 by means of a pivot pin 64 which allows the castor arm 60 to move at a rightangle to the track 28 as indicated by a fifth arrow 66. The driven wheel 40 and the idler wheel 44 are here shown as being of approximately the same diameter. It is to be understood that wheels 40, 44 of different diameters can be used. The idler wheel 44 is generally of a laser thickness than the driven wheel 40 and the idler wheel 44 and the driven wheel 40 are generally disposed above the top surface 68 of the track 28 with the nip 54 generally above and central over the groove 30.

The magnetic support slug 58 rests upon a microswitch 18 (generally the idler wheel displacement sensor of FIG. 1) and operates the microswitch 18. FIG. 4 shows the idler wheel 44 and the castor arm 60 in their preferred position. In this position the controller 10 receives input from the microswitch 18 indicative of the castor arm 60 and the idler wheel 44 not having been displaced from the preferred position as shown in FIG. 4.

The photo-optic document presence sensor is shown in FIGS. 3 and 4 as a light source 14A and a photodetector 14B. When the photodetector 14B detects a drop in the amount of light received from the light source (such as a light bulb or a light emitting diode) 14A, the controller 10 waits for a predetermined period sufficient for the approaching document 26 to have entered the nip 54 at its known velocity along the track 28. Once a document 26 has entered the nip 54 the controller 10 waits until any displacement condition will have become established in the castor arm 60 and the idler wheel 44, and then monitors the output of the microswitch 18. Thus, the controller 10 waits a predetermined period from output being received from the photodetector 14B before monitoring the output of the microswitch 18.

In the present invention it is to be understood that the light source 14A and the photodetector 14B can equally form part of a multiple document detector according to the prior art, looking for step changes in light transmission between the light source 14A and the photosensor 14B, and as hereinbefore described.

The driven wheel 40 and the idler wheel 44 are both made of elastic polymer material, and for preference, are made from rubber. It is to be understood that the microswitch 18 can be replaced by any device which senses movement of the magnetic slug 58 from a position shown in FIG. 4. For example, optical sensors, or magnetic induction sensors can equally be used.

Not shown in FIG. 3 but shown in FIG. 4 is a solenoid 70 which generally corresponds to the displacement means 22 of FIG. 1. The solenoid 70 magnetizes a core 72 which in turn is operative, when the solenoid 70 is energized, to attract the magnetic support slug 58 away from the preferred position shown in FIG. 4 in the direction of the fifth arrow 66.

Figure 5:
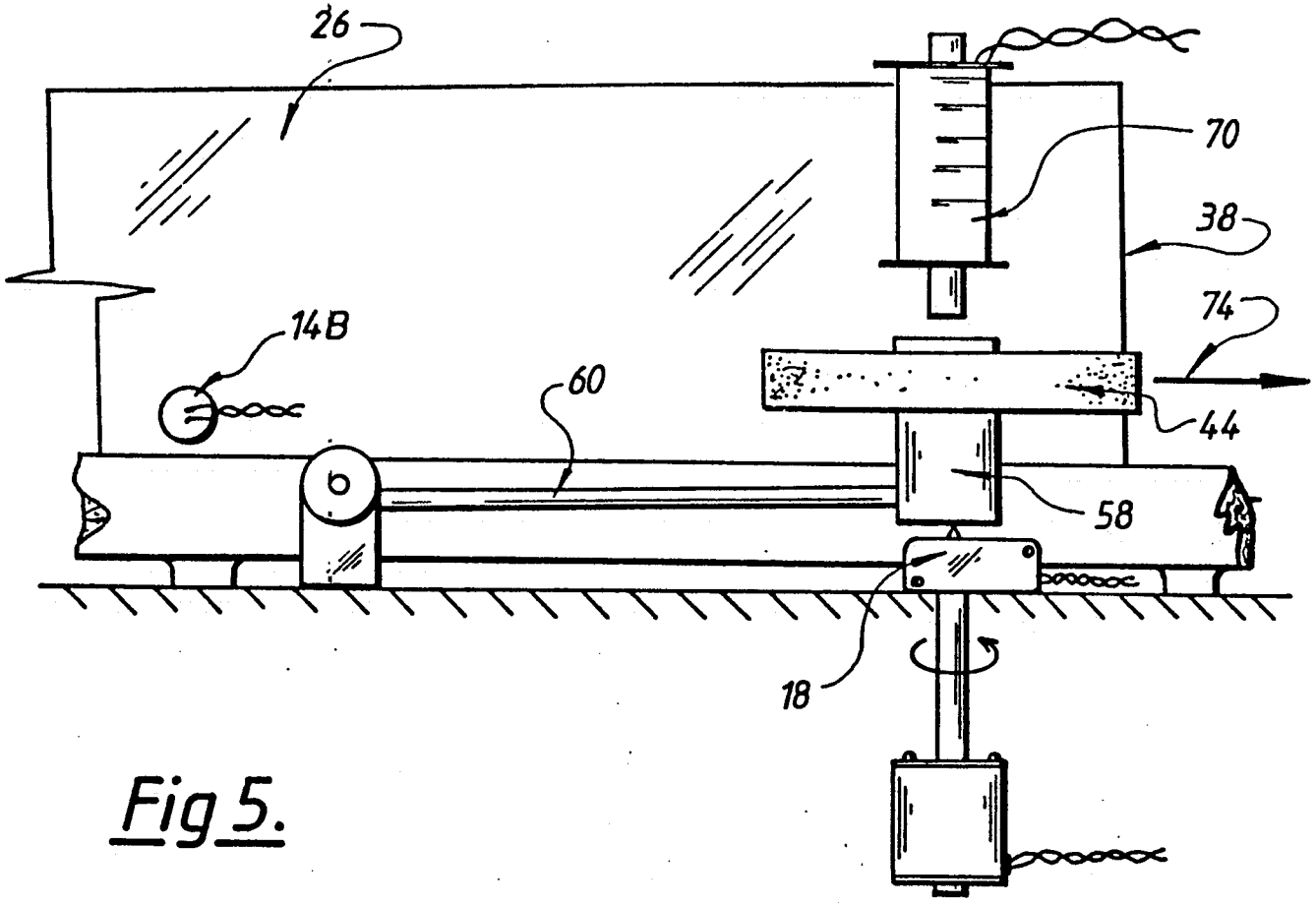

FIG. 5 shows a single document passing through the document sensor of FIGS. 3 and 4.

The surface of the driven wheel 40 and of the idler wheel 44 both have a coefficient of friction against a document 26 which is greater than the coefficient of friction of a document 26 against another document 26, 34. The idler wheel 44 and the driven wheel 40 are urged together with a predetermined force determined by the elastic properties of their rubber or polymer composition. Alternatively, in a less desirable but more complex manner, equally usable within the terms of the present invention, the two wheels 44, 40 can be urged together using springs and in particular, the castor arm 60 can be made elastic to provide the necessary force.

The solenoid 70, when operated with the magnetic support slug 58 in the preferred position, exerts a predetermined force which is insufficient to cause the idler wheel 44 to slide either against a document 26 or against the surface of the driven wheel 40 should a document 26 not be present. The force, exerted by the solenoid 70 upon the magnetic support slug 58, is sufficient to cause one document 26 to slide against another 26, 34 should two documents together be presented into the nip 54.

When the photodetector 14B detects the leading edge 38 of the document 26, it waits, as hereinbefore described, a predetermined time as the document 26 moves as indicated by a sixth arrow 74 until the leading edge 38 of the document 26 has entered the nip 54 and has progressed a predetermined distance there-beyond. Since the document 26 travels with constant velocity, this is equivalent to a simple time delay.

In FIG. 5, since the solenoid 70 does not exert sufficient force to cause the idler wheel 44 to move from its preferred position, and since the castoring action of the castor arm 60 and the idler wheel 44 exerts a force also indicated by the sixth arrow 74 tending to keep the idler wheel 44 in its preferred position as shown, the idler wheel 44 does not move and the microswitch 18 detects no displacement of the idler wheel (or magnetic support slug 58) from the preferred position.

Figure 6:
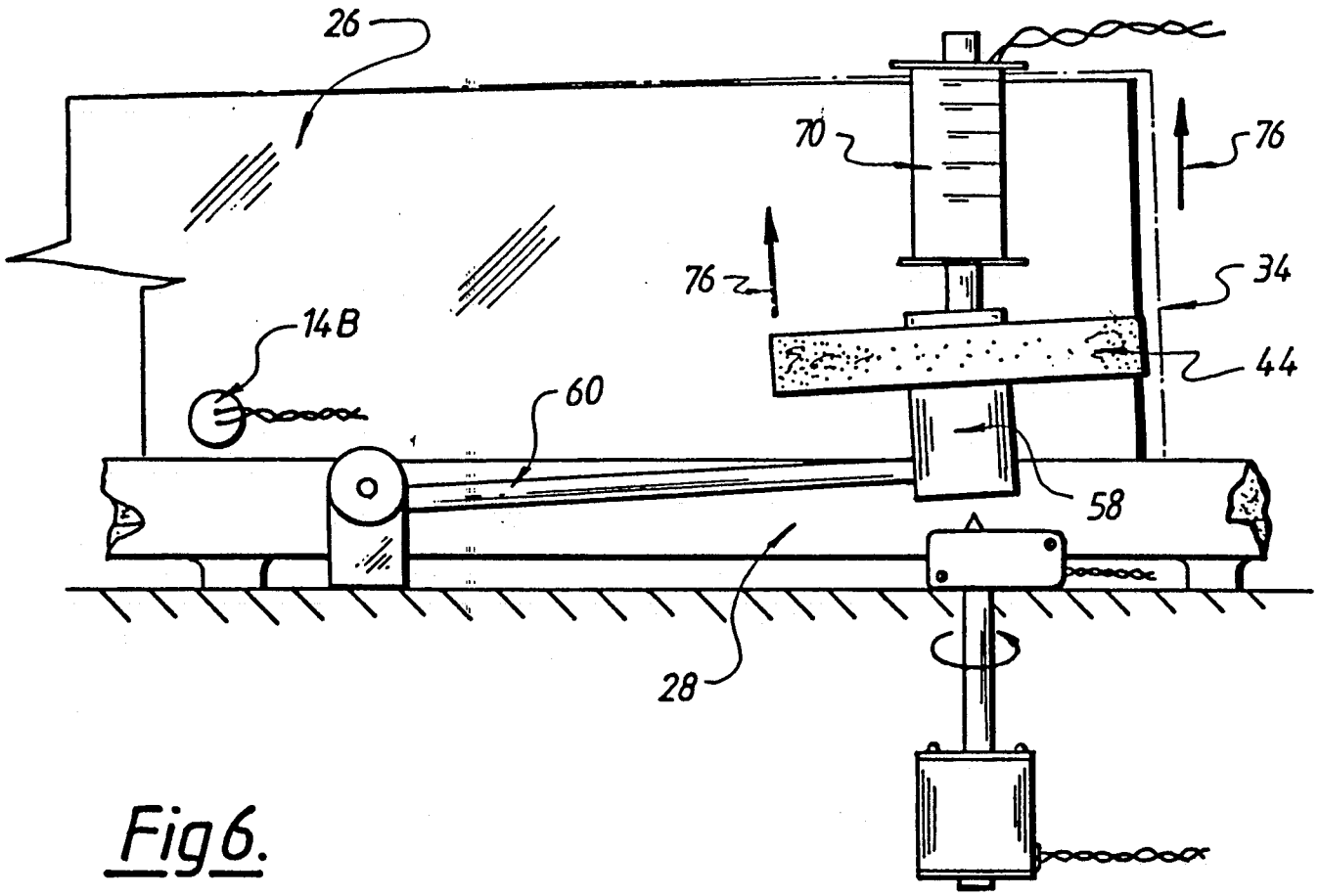

FIG. 6 shows the multiple document sensor of FIGS. 3, 4 and 5 with two documents passing there-through. In FIG. 6 the undesired document 34 is shown in phantom outline and is in fact the document adjacent to the idler wheel 44. The desired document is adjacent to the driven wheel 40. The solenoid 70 exerts sufficient force upon the magnetic support slug 58 to cause the idler wheel 44, gripping the surface of the undesired document 34, to cause the undesired document 34 to move with the idler wheel 44, as generally indicated by a seventh arrow 76, away from the track 28 by virtue of the undesired document 34 sliding against the desired document 26 which remains in registration with the driven wheel 40. The tilted attitude of the idler wheel 44 now means that the undesired document 34 is driven progressively out of the track 28 as indicated by the seventh arrow 76 to become prominent and noticeable.

It is intended that the present invention also provides the prime motive means for documents 26 along the track. The drive wheels assemblies (consisting in a pinch wheel and driven wheel) found along a document path in a document encoding equipment and other similar equipment, are replaced by multiple document detectors according to the present invention providing the dual function of document driving and multiple document detection.

When the trailing edge of a document 26 has passed the photodetector 14B and a predetermined period has elapsed, the solenoid 70 is de-energized by the controller 10. Should the idler wheel 44 have attained the position shown in FIG. 6 (that is, the displaced position away from the preferred position of FIGS. 4 and 5), castoring action against the idler wheel 40 causes return to the position shown in FIGS. 4 and 5 (that is, the preferred position). It is also provided that the magnetic support slug 58, the castoring arm 60 and the idler wheel 44 together are sufficiently heavy to allow gravity to assist in return from the position shown in FIG. 6 to the position shown in FIGS. 4 and 5.

We claim:

1. A document detector for detecting multiple documents moving along a track, said detector comprising:

a driven wheel having a peripheral velocity equal to the velocity of a document in the track;

an idler wheel, means for supporting said idler wheel in a manner to permit its movement in a transverse direction relative to the direction of movement of a document, said supporting means urging said idler wheel against said driven wheel to form a nip to accept a document; said idler wheel having a preferred position relative to said driven wheel;

displacement means operative to urge said idler wheel away from said preferred position in said transverse direction, said displacement means permitting said idler wheel to remain in said preferred position in the presence of a single document in said nip and causing said idler wheel to deviate from said preferred position in response to the presence of multiple document in said nip; and sensor means for detecting a deviation of said idler wheel from said preferred position.

2. A document detector according to claim 1 wherein the respective coefficients of friction of said driven wheel and said idler wheel are greater than the coefficient of friction between adjacent surfaces of multiple documents in said nip, said displacement means exerting a force on said idler wheel, said force being insufficient to overcome the friction between said idler wheel and the surface of a single document in said nip, thereby permitting said idler wheel to remain in said preferred position, and said force being sufficient to overcome the friction between adjacent surfaces of multiple documents in said nip, thereby causing said idler wheel to deviate from said preferred position as the document in contact with said idler wheel slides against the adjacent document in said nip.

3. A document detector according to claim 2 wherein said combination of said driven wheel and said idler wheel also act as drive wheels to urge a document along said track.

4. A document detector according to claim 2 further including a castor arm having a distal end and a proximal end, said idler wheel being coupled to said distal end of said castor arm, said idler wheel remaining in said preferred position when a single document is in said nip as a result of castoring action against the moving document.

5. A document detector according to claim 4 wherein proximal end of said castor arm is pivotally mounted adjacent to said track, said arm being capable of movement in a direction transverse to that of a moving document.

6. A document detector according to claim 5 characterized in that said idler wheel is coupled to said castor arm by an idler wheel bearing disposed on a magnetic support slug.

7. A document detector according to claim 6 wherein said displacement means comprises an electromagnet, means for energizing said electromagnet to attract said magnetic support slug and its associated idler wheel.

8. A document detector according to claim 7 wherein said sensor means provides an output signal indicative of the deviation of said idler wheel from said preferred position.

9. A document detector according to claim 8 wherein said sensor means is a microswitch disposed in contact with said magnetic support slug when said idler wheel is in said preferred position.

10. A document detector according to claim 8 further including a document presence sensor operative to detect the presence of a document moving in said track and to provide an output indicative of the entrance of the document into said nip, said displacement means being energized only when said document presence sensor provides said output.

11. A document detector according to claim 10 further characterized in that said idler wheel, when deviated from said preferred position, is operative to urge the document in contact therewith, out of said track in a direction transverse to the movement of the document along said track.

12. A document detector according to claim 11 further characterized in that said idler wheel assumes an angled position with respect to said track as a result of its deviation from said preferred direction, the displacement of the document in contact with said idler wheel resulting from said angled position.

* * * * *